US006036065A

United States Patent [19]

Wofford et al.

[11] Patent Number: 6,036,065

[45] Date of Patent: Mar. 14, 2000

[54] JEWELRY INSTALLATION DEVICE

[76] Inventors: Barry Wofford; Pamela D. Wofford, both of 2123 Whitechapel Dr., Toledo, Ohio 43614

[21] Appl. No.: 09/007,875

[22] Filed: Jan. 15, 1998

[51] Int. Cl.[7] ..... A47G 25/80

[52] U.S. Cl. ..... 223/111; 223/DIG. 2; 24/556; 294/3.6

[58] Field of Search ..... 223/111, DIG. 2; 24/556, 564, 521, 571, 507; 294/36

[56] References Cited

U.S. PATENT DOCUMENTS

| | | | |
|---|---|---|---|
| 4,650,141 | 3/1987 | Longo et al. . | |
| 5,405,066 | 4/1995 | Faker | 223/111 |
| 5,709,327 | 1/1998 | LaMacchia et al. | 223/111 |
| 5,741,035 | 4/1998 | Glass . | |
| 5,785,217 | 7/1998 | Gorham, Jr. | 223/111 |
| 5,899,369 | 5/1999 | Macripo | 223/111 |

OTHER PUBLICATIONS

Bright Life Sales Catalogue.

*Primary Examiner*—Bibhu Mohanty
*Attorney, Agent, or Firm*—MacMillan, Sobanski & Todd, LLC

[57] ABSTRACT

A jewelry installation device comprising a clamping device for operatively supporting a spring ring for coupling ends of an article of jewelry together, comprises a support and a clamp supported by the support. The support may comprise a handle structured and configured to be grasped between the fingers and the palm of a user's hand so as to orient the clamp proximate the wrist of the user. The clamp is structured and configured to hold the spring ring of a chain bracelet in an open position and proximate the wrist of the user, rendering both hands of the user free to grasp and operate the spring ring and manipulate the jump ring of the chain (opposite the spring ring) to engage the jump ring with the spring ring. Upon opening the clamp, the spring ring is released and upon being released, the spring ring closes upon the jump ring, coupling the spring ring and jump ring together.

19 Claims, 4 Drawing Sheets

JEWELRY INSTALLATION DEVICE

BACKGROUND OF THE INVENTION

This invention relates generally to jewelry clasps for coupling ends of an article of jewelry together. In particular, this invention relates to a jewelry installation device in the form of a clamping device adapted for use in supporting and operating a clasp for coupling a bracelet on the wrist of a user.

The use of jewelry has been quite popular in most cultures throughout history and remains popular today. Jewelry is typically worn as an accessory to complement apparel, to make a statement, or merely because it is trendy to do so. The most common forms of jewelry include jewelry which is body piercing, appended to the user's apparel, or draped or fastened about an appendage of the user's person. Necklaces and bracelets are examples of jewelry which drape or fasten about a user's appendage. They may be rigid or pliant but in either case, they commonly comprise a closed loop structure which may be opened to permit the same to be draped about the neck or other appendage of the user. Rigid jewelry is generally easier to open and close than jewelry which is pliant, such as necklaces and more particularly, bracelets which are malleable. Chain necklaces and bracelets, for example, typically have a spring ring at one end and a jump ring at an opposing end. The jump ring is matingly engageable with the spring ring to hold the chain in a closed loop configuration. The spring ring includes a movable section which is normally biased in a closed position and tabs which cooperatively operate to move the movable section to an open position. The jump ring is a ring which is received by the spring ring when the spring ring is in an open position. Once the jump ring is received by the spring ring, the spring ring is closed to retain the jump ring. Operating a spring ring typically does not pose a problem if the chain is a necklace, a belly bracelet, or an ankle bracelet because the user has one hand free to grasp and operate the spring ring and another hand free to grasp and manipulate the jump ring. This is not the case if the chain is to be worn as a bracelet about a user's wrist, however, because the user must grasp and operate the spring ring and manipulate the jump ring all with a single hand. This can be frustrating and cumbersome to the user.

SUMMARY OF THE INVENTION

This invention relates to a jewelry installation device comprising a clamping device for operatively supporting a jewelry clasp for coupling ends of an article of jewelry together. The clamping device comprises a support and a clamp supported by the support. The support may comprise a handle structured and configured to be grasped between the palm and fingers of the user's hand and conform to the user's lower palm. The support engages the clamp to support the clamp firmly in a position proximate the wrist of the user when grasped by the user. The clamp has an upper and lower jaw at its proximal end and comprises a biasing element which biases the jaws closed. Upon pinching the distal end of the clamp, the jaws are urged open. Upon releasing the distal end of the clamp, the jaws are biased closed. The jaws include grooves for engaging and receiving the spring ring of a chain. Holes are also disposed along opposite ends of the groove for receiving the tabs of the spring ring. The tabs are operable to open the spring ring. With the holes receiving the tabs and upon closing the clamp, the spring ring is urged open to receive a jump ring, which is matingly engageable with the spring ring. When the clamp is opened, the tabs are released and the spring ring closes to engage and retain the jump ring.

Various objects and advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
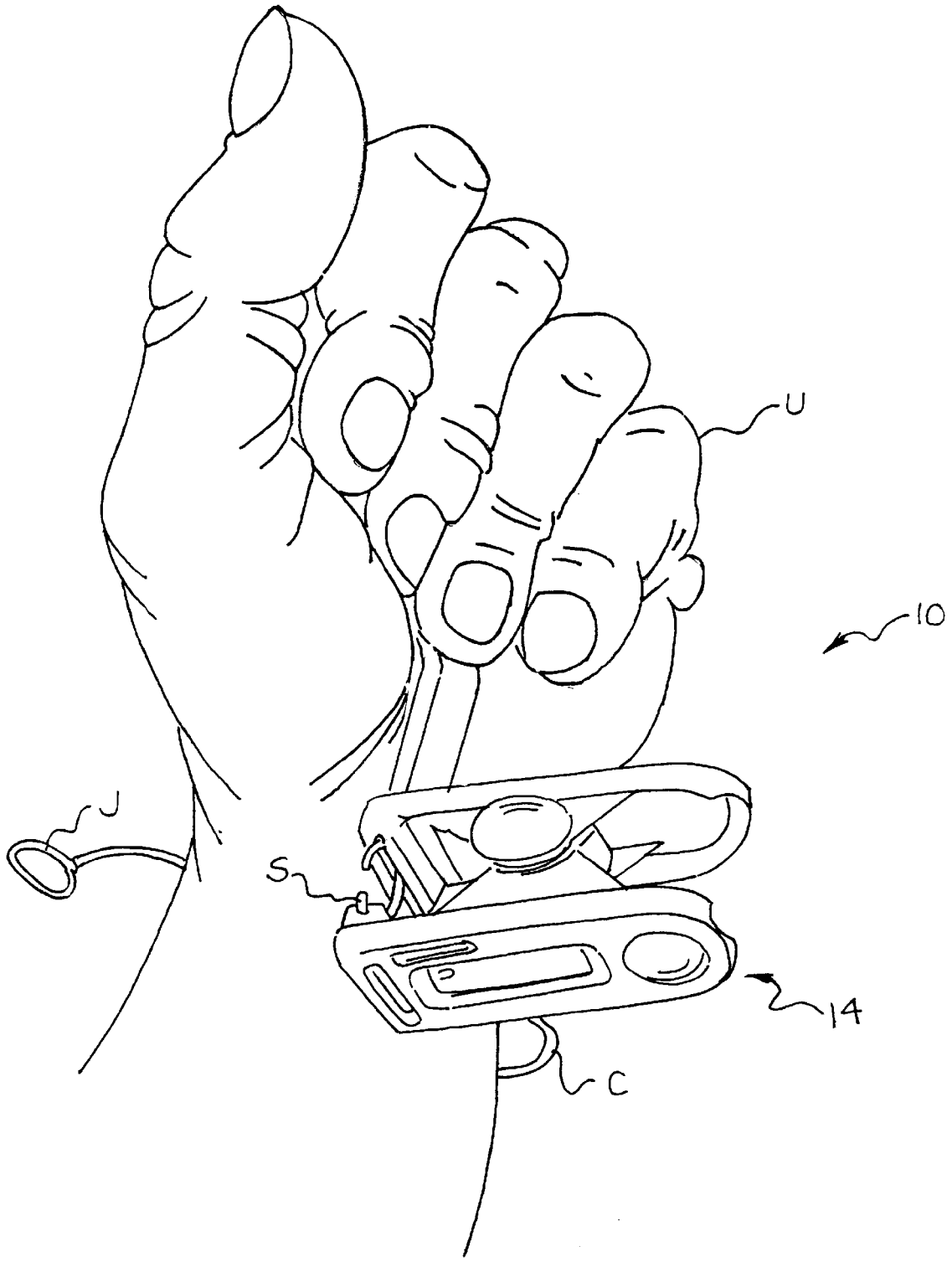
FIG. 1 is an environmental perspective view of a jewelry installation device grasped between the palm and fingers of a user's hand.

Referring now to the drawings, there is illustrated in FIG. 1 a jewelry installation device comprising a clamping device 10 adapted for use in operating a clasp for coupling an article of jewelry on the wrist of the user U. The clamping device 10 comprises a support 12 and a clamp 14 supported by the support 12. The support 12 is adapted to be grasped between the fingers and the palm of the user's hand and is dimensioned and configured to orient the clamp 14 proximate the wrist of the user when grasped by the user. The clamp 14 is structured and configured to hold the clasp of an article of jewelry, such as the spring ring S of the chain C shown, in an open position and proximate the wrist of the user. The clamp 14 renders the both hands of the user free to grasp and operate the spring ring S and manipulate the jump ring J opposite the spring ring S. With the spring ring S open and supported by the clamp 14, the jump ring J is received by the spring ring S. Upon releasing the spring ring S from the clamp 14, the spring ring S closes upon the jump ring J, coupling the spring ring S and the jump ring J together.

Figure 2:
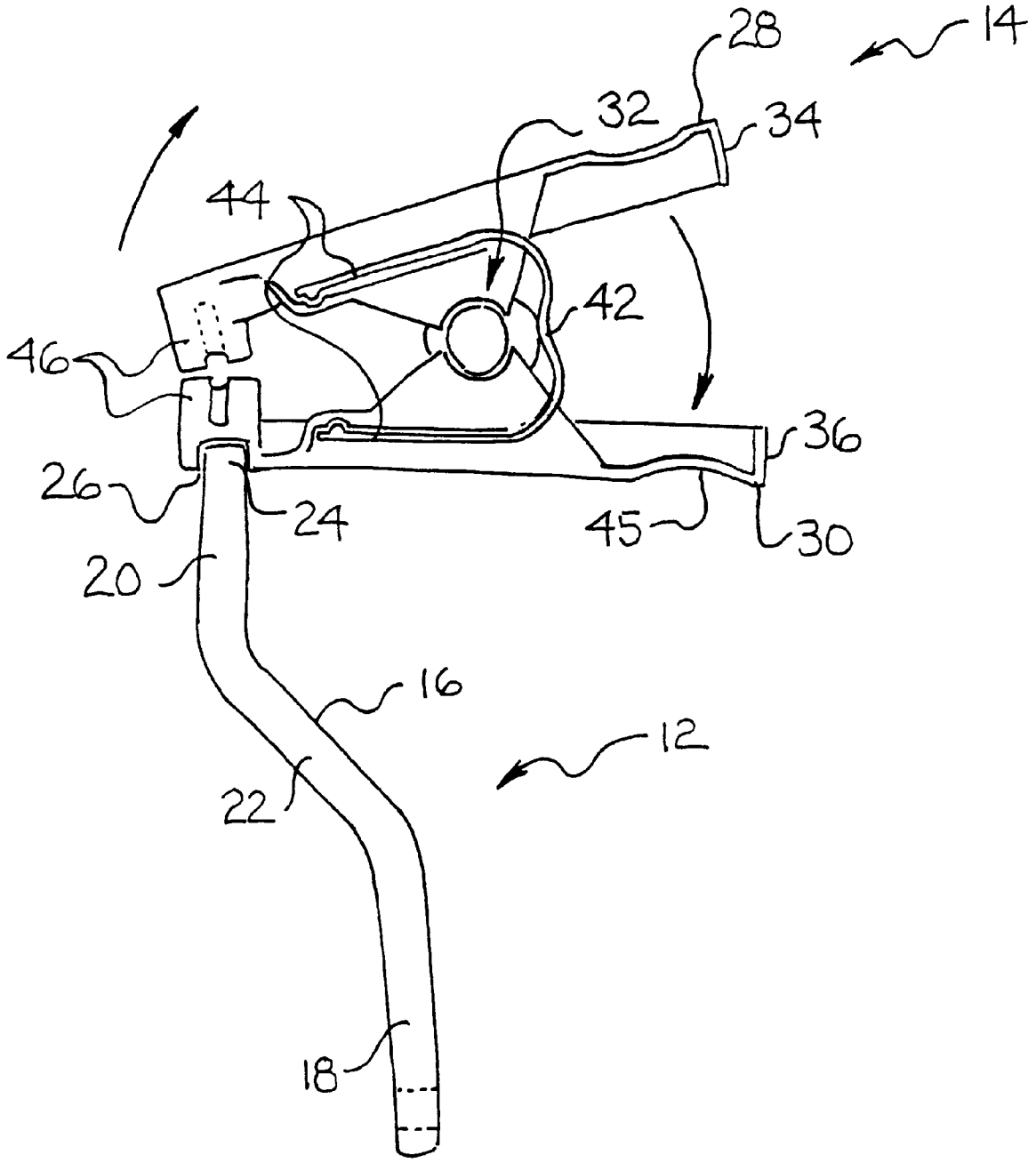
FIG. 2 is a partially cutaway side elevational view of the jewelry installation device shown in FIG. 1.
Figure 3:
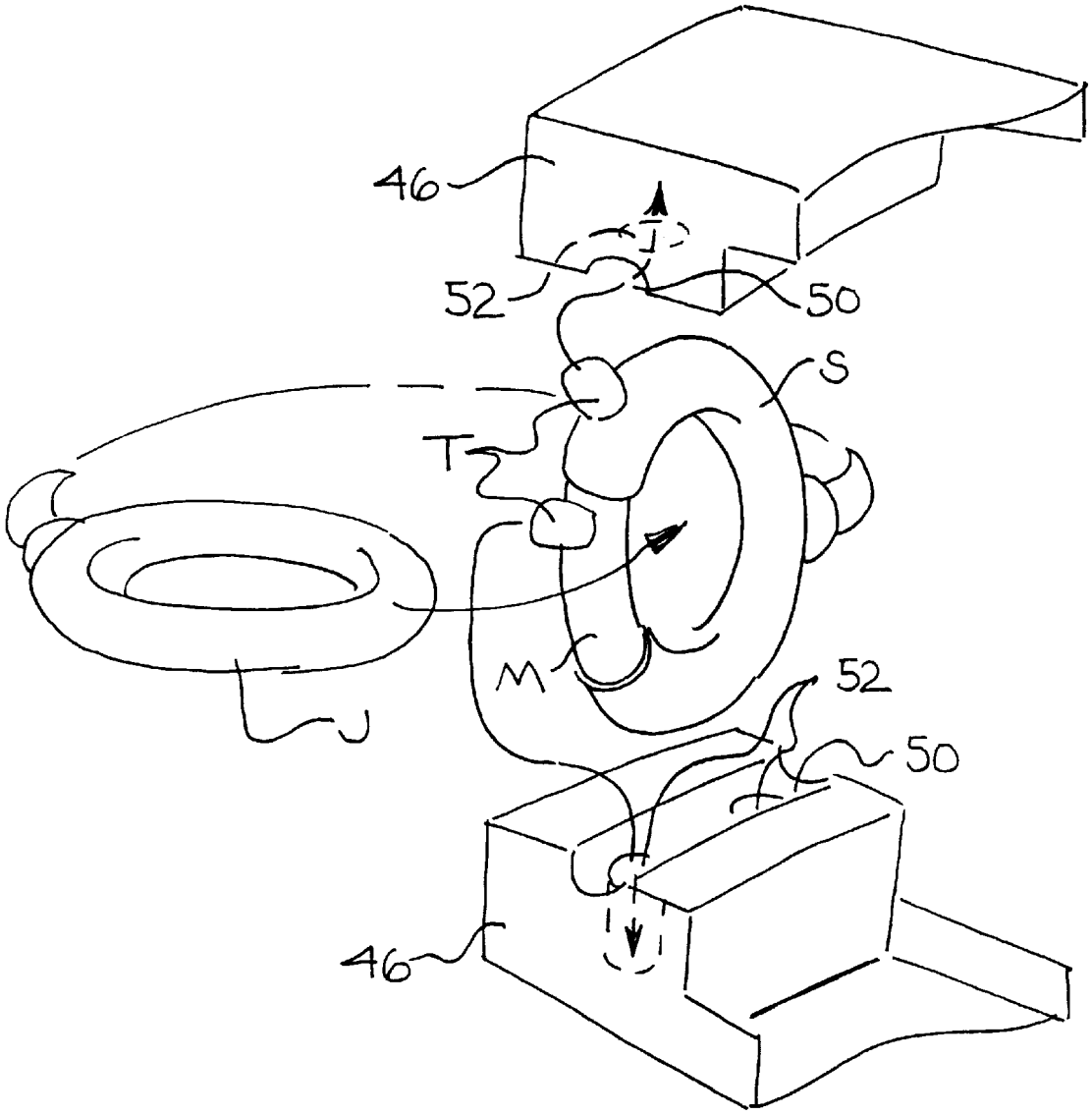
FIG. 3 is an enlarged partial environmental perspective view of a jaw of the jewelry installation device shown in FIG. 1.
Figure 4:
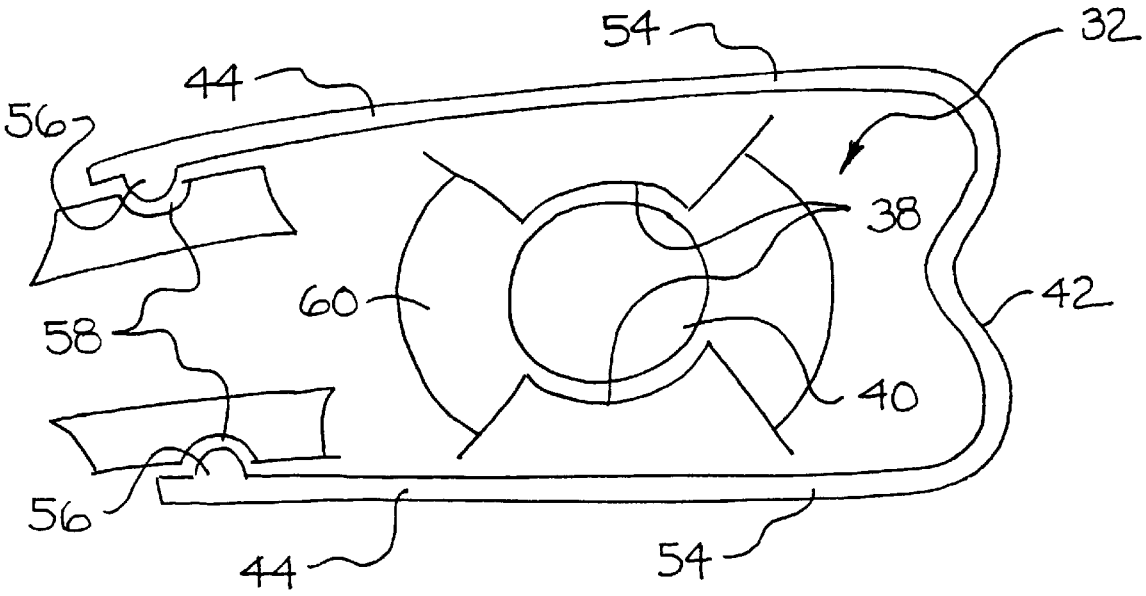
FIG. 4 is an enlarged diagrammatic representation of a biasing element and the pivot point of the jewelry installation device shown in FIG. 1.

Now referring to FIGS. 2 through 4, the support 12 is shown comprising a handle structured and configured substantially in the form of a Z-shaped member 16. The Z-shaped member 16 comprises two opposing ends 18, 20 and an intermediate section 22 interposed between the two opposing ends 18, 20. A first end 18 of the opposing ends 18, 20 is structured to rest upon the lower palm of the user's hand adjacent the user's wrist. The intermediate section 22 adjoins the first end 18 of the handle 12 and is angularly offset so as to curve about, or substantially conform to, the lower palm of the user's hand and terminate at wrist of the user. The intermediate section 22 terminates in the second end 20 of the handle 12. The second end 20 of the handle 12 is oriented so as to be directed away from and substantially perpendicular to the wrist of the user and in a plane substantially coplanar to the first end 18 of the handle 12. A handle which is substantially flat may provide greater control over the clamp 14 supported thereby, as opposed to a rounder handle, which may have a tendency to roll or turn when grasped by the user.

The support 12 engages the clamp 14 to support the clamp 14 firmly in a position proximate the wrist of the user. The support 12 may be fixedly or releasably attached to the clamp 14. One manner in which the support 12 may be releasably attached to the clamp 14 is by providing the support 12 with an extended element or a protrusion 24 and the clamp 14 with an opening 26 for tightly or snugly receiving the protrusion 24 of the support 12.

The clamp 14 comprises a first and second member 28, 30 which are pivotally attached to one another at a pivot point by a pivotal connection 32. The first and second members 28, 30 of the clamp 14 have proximal and distal ends 34, 36. The support 12 preferably engages a bottom side of the distal end 34 of the clamp 14 substantially at a right angle relative to the clamp 14 so that the bottom of the clamp 14 lies in a plane substantially parallel to the user's wrist.

Intermediate the proximal and distal ends 34, 36 of the first and second members 28, 30 are inwardly directed cam surfaces 38. The cam surfaces 38 receive and mutually engage a bearing pin 40 upon which the first and second members 28, 30 pivot. A biasing element 42, such as the C-shaped spring metal element shown, has opposing ends 44, each of which engage a respective one of the first and second members 28, 30 to bias the proximal ends 34 of the first and second members 28, 30 toward and into engagement with one another and the distal ends 36 of the first and second members apart from one another. Upon pinching the distal ends 36 of the first and second members 28, 30 toward one another against the biasing force of the biasing element 42, the proximal ends 34 of the first and second members 28, 30 are urged apart or away from one another. Upon releasing the distal ends 36 of the first and second members 28, 30, the biasing force of the biasing element 42 urges the proximal ends 34 of the first and second members 28, 30 toward and back into engagement with one another. Depressions 45 may be formed in outer surfaces of the distal ends 36 of the first and second members 28, 30 to enhance the user's grip of the clamp 14 and thereby improve the user's control of the clamp 14.

The distal ends 36 of the first and second members 28, 30 of the clamp 14 include mutually engageable surfaces defined by jaws 46. The jaws 46 shown in the drawings are exaggerated by inwardly directed raised lateral surfaces 48. It is preferable that the jaws 46 be provided with a laterally extending grooves 50. The grooves 50 are dimensioned and configured to engage and receive the peripheral edge of a spring ring S supported by the clamp 14. The grooves 50 extend to the lateral extremities of the raised lateral surfaces 48. This symmetrical arrangement permits the user to operate the clamping device 10 whether putting an article of jewelry on the right or left wrist. Moreover, holes 52 may be provided adjacent the lateral extremities of each raised lateral surfaces 48. The holes 52 are adapted to receive tabs T of a spring ring S (shown in FIG. 3). The tabs T operatively control the displacement of a movable section M of the spring ring S. With the tabs T received by respective holes 52 and upon closing the clamp 14, the movable section M of the spring ring S is urged open and thus, permitted to receive a jump ring J (shown in FIG. 3 opposite the spring ring S). Subsequent to receiving the jump ring J, the spring ring S is closed by opening the clamp 14 which, in turn, releases the tabs T from the holes 52 and allows the movable section M of the spring ring S to be biased closed.

In the embodiment shown, the biasing element 42 comprises a C-shaped spring metal element, as set forth above. The spring metal element comprises opposing legs 54 which extend toward the distal ends 36 of the first and second members 28, 30 of the clamp 14. The spring metal element further comprises an inwardly directed nodule 56 at the extremity of each of its opposing legs 54. The distal ends 36 of the first and second members 28, 30 of the clamp 14 each include a recess 58 for receiving a respective one of the inwardly directed nodules 56 for frictionally engaging the spring metal element 24 and the first and second members 28, 30.

The pivotal connection 32 shown is comprised of inwardly directed cam surfaces 38 and a bearing pin 40, as described above. The bearing pin 40 shown comprises a stop 60 at each of its lateral extremities to prevent the bearing pin 40 from shifting laterally and escaping from between the opposing cam surfaces 38.

In operation, a spring ring S is received by the clamping device 10 in a manner such that the spring ring S is held in an open position and the opening is accessible to the user. The support 12 of the clamping device 10 is then positioned with the first end 18 of the support 12 adjacent the user's palm and the clamp 14 proximate and substantially parallel to the user's wrist. The user is then unencumbered to grasp the jump ring J of the article of jewelry with his or her free hand and engage the jump ring J with the open spring ring S. With the jump ring J engaging the open spring ring S, the clamp 14 is opened by pinching the proximal ends 34 of the two members of the clamp 14 toward one another and against the biasing force of the biasing element 42. Upon opening the clamp 14, the spring ring S is released from the clamp 14 and upon being released, the spring ring S closes to engage and retain the jump ring J. At this juncture, the sping ring S and jump ring J of the chain C are coupled together to retain the chain C on and about the user's wrist.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A clamping device for supporting a jewelry clasp, comprising:

a clamp including first and second members, said first member being pivotally attached to said second member, said first and second members each having a proximal end, said proximal ends of said first and second members cooperatively defining jaws having mutually engageable surfaces, said mutually engageable surfaces each including a groove, each said groove being dimensioned and configured to receive a jewelry clasp having tabs which operatively open and close the jewelry clasp, each said groove further having an extremity and a hole in said groove proximate said extremity, each said hole being dimensioned and configured to receive a respective one of the tabs of the jewelry clasp; and a biasing element engaging said first and second members for biasing said mutually engageable surfaces toward one another.

2. A clamping device according to claim 1, further comprising:

a support for supporting said clamp firmly in a position adjacent the user's wrist when said support is grasped by the user.

3. A clamping device according to claim 2, wherein said support comprises:

a handle, said handle comprising:

having a first end, said first end being dimensioned and configured to be grasped between the user's palm and fingers; and a second end opposite said first end, said second end being dimensioned and configured to support said clamp firmly in a position adjacent the user's wrist when said first end is grasped between the user's palm and fingers.

4. A clamping device according to claim 3, wherein said handle further includes an angularly disposed intermediate section joining said first and second ends of said handle in an manner such that a coplanar relationship is maintained between said first and second ends of said handle, thus providing a substantialy Z-shaped handle.

5. A clamping device according to claim 2, wherein said clamp and said handle are structured to cooperatively and releasably engage one another.

6. A clamping device according to claim 1, wherein each said groove further has opposing extremities and a hole in said groove proximate each said extremity, each said hole being dimensioned and configured to receive the tabs of the jewelry clasp.

7. A clamping device according to claim 1, wherein said first member is pivotally attached to said second member by a pivotal connection, said pivotal connection comprising:

a first cam surface on said first member and a second cam surface on said second member, said first and second cam surfaces being inwardly directed and opposingly disposed, said first and second cam surfaces further being spaced a predetermined distance from said proximate ends of said first and second members, respectively; and a bearing pin, said first and second cam surfaces being mutually engageable with said bearing pin.

8. A clamping device according to claim 1, wherein said biasing element comprises:

a C-shaped element having opposing legs, each one of said legs ends being engageable with a respective one of said first and second members, said C-shaped member further being arranged and configured to bias said proximate ends of said first and second members toward with one another.

9. A clamping device according to claim 8, wherein said C-shaped element comprises a spring metal element.

10. A clamping device according to claim 1, wherein said first and second members each further comprise a distal end opposite said proximal end thereof, said distal end comprising:

an outer surface; and a depression in said outer surface of said distal end.

11. A clamping device for supporting a jewelry clasp, comprising:

a support including a handle having a first end adapted to be grasped between the user's palm and fingers, a second end adapted to support said clamp firmly in a position adjacent the user's wrist, and an angularly disposed intermediate section joining said first and second ends of said handle so as to maintain a co-planar relationship between said first and second ends of said handle; and a clamp supported by said support, said clamp including first and second members, said first member being pivotally attached to said second member, said first and second members each having a proximal end, said proximal ends of said first and second members cooperatively defining jaws having mutually engageable surfaces; and a biasing element engaging said first and second members for biasing said mutually engageable surfaces toward one another, said support being dimensioned and configured to support said clamp firmly in a position adjacent the user's wrist.

12. A clamping device according to claim 11, wherein said clamp and said support are structured to cooperatively and releasably engage one another.

13. A clamping device according to claim 11, wherein said mutually engageable surfaces each include a groove, each said groove being dimensioned and configured to receive a jewelry clasp having tabs which operatively open and close the jewelry clasp, each said groove farther having an extremity and a hole in said groove proximate said extremity, each said hole being dimensioned and configured to receive a respective one of the tabs of the jewelry clasp.

14. A clamping device according to claim 13, wherein each said groove further has opposing extremities and a hole in said groove proximate each said extremity, each said hole being dimensioned and configured to receive the tabs of the jewelry clasp.

15. A clamping device according to claim 11, wherein said first member is pivotally attached to said second member by a pivotal connection, said pivotal connection comprising:

a first cam surface on said first member and a second cam surface on said second member, said first and second cam surfaces being inwardly directed and opposingly disposed, said first and second cam surfaces further being spaced a predetermined distance from said proximate ends of said first and second members, respectively; and a bearing pin, said first and second cam surfaces being mutually engageable with said bearing pin.

16. A clamping device according to claim 11, wherein said biasing element comprises:

a C-shaped element having opposing legs, each one of said legs ends being engageable with a respective one of said first and second members, said C-shaped member further being arranged and configured to bias said proximate ends of said first and second members toward with one another.

17. A clamping device according to claim 16, wherein said C-shaped element comprises a spring metal element.

18. A clamping device according to claim 11, wherein said first and second members each further comprise a distal end opposite said proximal end thereof, said distal end comprising:

an outer surface; and a depression in said outer surface of said distal end.

19. A clamping device for supporting a jewelry clasp comprising:

a clamp including first and second pivotably connected members having respective ends that define a jaw having engageable surfaces, at least one of said engageable surfaces including a groove that is adapted to receive a jewelry clasp therein, said groove having a hole formed therein that is adapted to receive a tab provided on the jewelry clasp; and an element for biasing said mutually engageable surfaces of said first and second members toward one another.

* * * * *